US006129019A

United States Patent [19]

Tobol et al.

[11] Patent Number: 6,129,019

[45] Date of Patent: Oct. 10, 2000

[54] PRINTER CLEANING CARD INTEGRATED INTO WEB OF PRINTABLE LABELS

[75] Inventors: Gretchen Tobol, Grand Island; Dom Monico, Williamsville, both of N.Y.

[73] Assignee: Moore U.S.A., Inc., Grand Island, N.Y.

[21] Appl. No.: 09/070,779

[22] Filed: May 1, 1998

[51] Int. Cl.[7] ..... B41F 35/00

[52] U.S. Cl. ..... 101/424; 101/483; 15/104.93; 15/210.1

[58] Field of Search ..... 101/424, 423, 101/425, 483; 15/104.93, 208, 209.1, 210.1

[56] References Cited

U.S. PATENT DOCUMENTS

| | | | |
|---|---|---|---|
| 3,069,815 | 12/1962 | Valentine | 15/210.1 |
| 3,827,699 | 8/1974 | Waugh | 15/210.1 |
| 4,154,883 | 5/1979 | Elias | 15/209.1 |
| 4,357,615 | 11/1982 | Yoshiharu et al. | 346/134 |
| 4,479,136 | 10/1984 | Lewis et al. | 346/140 R |
| 4,603,069 | 7/1986 | Hag et al. | 15/209.1 |
| 4,829,897 | 5/1989 | Wyman et al. | 101/483 |
| 4,891,265 | 1/1990 | Samagalsky | 15/104.93 |
| 4,931,201 | 6/1990 | Julemont | 15/104.93 |
| 4,933,015 | 6/1990 | White | 134/6 |
| 5,153,964 | 10/1992 | Gelardi et al. | 15/229.12 |
| 5,223,329 | 6/1993 | Amann | 15/104.93 |
| 5,227,226 | 7/1993 | Rzasa | 428/219 |
| 5,239,316 | 8/1993 | Demarchi et al. | 346/140 R |
| 5,525,417 | 6/1996 | Eyler | 428/286 |
| 5,536,328 | 7/1996 | Morgavi | 134/6 |
| 5,589,865 | 12/1996 | Beeson | 347/28 |

FOREIGN PATENT DOCUMENTS

| | | | |
|---|---|---|---|
| 0 531 992 A2 | 3/1993 | European Pat. Off. . | |
| 0 783 978 | 7/1997 | European Pat. Off. . | |
| 0 822 093 | 2/1998 | European Pat. Off. . | |
| 3442677 | 5/1986 | Germany | 15/104.93 |
| 88 09 401 U | 9/1988 | Germany . | |
| WO 92 04990 | 4/1992 | WIPO . | |
| WO 93/21020 | 10/1993 | WIPO . | |

OTHER PUBLICATIONS

Patent Abstracts Of Japan, vol. 12, No. 190, Jun. 3, 1998 & JP 62 297172 A, Dec. 24, 1987.

Moore® Thermal Printing Cleaning Card brochure, May 28, 1996 (8 pp.).

Moore® Specification Sheet, Thermal Printer Cleaning Card, Jan. 12, 1998 (4 pp.).

*Primary Examiner*—John S. Hilten
*Assistant Examiner*—Anthony H. Nguyen
*Attorney, Agent, or Firm*—Nixon & Vanderhye P.C.

[57] ABSTRACT

A printer cleaning cloth is described having multiple plies sonically or thermally bonded together. An embossed pattern of the cleaning cloth provides stiffness and rigidity to the cloth and imparts a roughened surface texture to the cloth. The cleaning cloth is soaked in a terpene cleaning solvent. The cleaning cloth is attached to a roll of printing labels and passes through the printer at the beginning or end of the label roll. As the cloth passes through the printer, the cloth wipes clean the printer, especially the printheads to the printer.

13 Claims, 2 Drawing Sheets

PRINTER CLEANING CARD INTEGRATED INTO WEB OF PRINTABLE LABELS

FIELD OF THE INVENTION

The present invention relates to the field of printers, and in particular apparatus and methods for cleaning high-speed printers of large rolls of labels.

BACKGROUND AND SUMMARY OF THE INVENTION

High-speed printers are often used to print large numbers of labels from rolls of blank labels. High-speed printers may be printers with banks of ink-jet printer heads, of thermal printheads, a laser printer or other type of printer. The printer is adapted to receive a continuous web of labels from a roll of labels. The printer may be computer controlled to print different text, graphics or other indicia on each label. For example, the printer may print a different addressee and address on thousands of mailing labels to be applied to a subscription magazine.

These high-speed printers are often in great demand and required to operate continuously for large periods of time. For example, a magazine publisher ready to publish a weekly magazine must rapidly produce hundreds of thousands of labels in order to mail the magazine in a timely manner. The printer of such large numbers of labels for a magazine subscription requires nearly continuous operations of a large number of high speed label printers. Even a relatively small business office may have one or more label printers that are nearly continuously operated to print labels for mailing correspondence, packages and other materials to customers. Accordingly, there is a strong need for label printers that can continuously print labels without undue or frequent interruptions.

Printing labels is particularly difficult due to the excess toner, printing ink, paper dust, adhesive residue, and other debris that tends to clog the printers, especially printer nozzles. Labels present unusual difficulties to a printer because labels are often multi-ply forms, e.g., a liner and removable label, and because labels usually have adhesive coatings that clog printers and attract paper dust and other debris. Some of the adhesive from the adhesive coatings of labels may be left as a residue on the printer as each label passes through the printer. The tendency for some adhesive to stick to the printer is disadvantageously increased because multi-ply labels have additional web edges that may carry adhesive residue that attaches to the printer.

The adhesive residue left on printers, and especially printheads, by labels disrupts printing. The adhesive itself can clog printheads and disrupt the printing of clear, readable text on labels. In addition, when adhesive residue coats a printhead, the adhesive tends to be tacky or sticky. The stickiness of the adhesive attracts paper dust, extraneous ink and other debris which can also clog printheads.

The printers require regular cleaning to unclog printheads, and to remove adhesive and other debris material from the printheads. In the past, cleaning cards have been used to manually clean printers. The cleaning cards were soaked in a cleaning solvent and stored in sealed bags to prevent evaporation of the solvent. When a printer was to be cleaned, the printer was stopped, the label web may or may not have been removed from the printer and a cleaning card manually inserted into the printer between the printhead and platen. This use of cleaning cards disrupted normal printing operations and the feeding of label stock through the printers. In addition, the prior art printer cards, e.g., a 3 inch by 5 inch, or 4 inch by 6 inch card, required printer operators to schedule frequent cleaning operations and to adhere to that cleaning schedule. Failure to follow the prescribed cleaning schedule would lead to clogged printers, which resulted in poor print quality and having to shut down the printer at unscheduled times. Accordingly, prior art cleaning techniques using cleaning cards were necessary to maintain the printers, but caused disruptions to printing and imposed additional duties on print operators. There was a long felt need for a device and a method for cleaning printers that did not unnecessarily disrupt print operations, provided regular cleaning of the printer, and did not require printer operators to manually clean the printer or to follow a cleaning schedule (in addition to their other duties).

In addition, conventional printer cleaning cards were not satisfactory. For example, the conventional wisdom is that the solvent in the cleaning cards was isopropyl alcohol. Isopropyl alcohol is not particularly effective in cleaning adhesives and the other debris associated with printing labels. Recently, a terpene-based solvent has been used to soak thermal printer cleaning cards. Terpene solvents are effective at softening adhesives and for cleaning printers having adhesive residue. Terpene cleaning cards and/or terpene solvents are available from the Texwipe Company of Upper Saddle River, N.J. (U.S.A.); Planna Technology Inc. of Minneapolis, Minn. (U.S.A.) and Moore U.S.A. of Grand Island, N.Y. (U.S.A.). Terpene based solvents may include vegetable seed oil (esters), nonionic surfactants, inorganic water conditioner in suspension, anti-foaming agents and de-ionized water, or (alternatively) d-limonene, myrcene, alpha-pinene, linalool, octanal, and glycol ether DPM.

However, conventional printer cleaning cards have tended to be problematic. Such cleaning cards have been formed of paper card substrates or other non-woven materials such as polyester. The advantage of paper cards and non-woven fibers is that they are relatively rigid and stiff, which assists in inserting the card into the printer and in scraping off contaminants from the printer. In addition, paper and other non-woven substrates have a fiber length that is relatively short. When these short fibers from the cards are left in the printer they are less likely to clog the printer or interfere with printer operation than would the long fibers of a woven card or cloth. It is conventional wisdom that the long fibers of woven substrates are more likely than are short fibers to attach to the printhead when those long fibers separate from the print card and are left in the printer. However, paper substrates and other short fiber substrates do not retain solvents well and tend to leave too much solvent on the printer and platen roller. An attempt to overcome the shortcomings of paper card substrates has been made in which a ribbed cloth is apply to a polycard, but this attempt (which did used an abrasive rather than a terpene solvent) is not effective in cleaning label printers.

Despite the conventional wisdom not to use long-fiber, woven substrates for cleaning cards, woven substrates do generally have a larger capacity to retain cleaning solvents than do paper substrates and other short fiber substrates. Woven, long fiber cards soak up solvents, in a similar manner to a towel (which is a woven, long fiber material) soaking up water. Some prior printer cleaning cloths have been marketed that are made of cloth toweletts, such as by Planna Technology Inc. While these cloth toweletts are effective (especially when soaked with a terpene solvent), they do not clean all contaminants off a printer. For example, removal of printing ink (similar to the ink in a ballpoint pen) is particularly difficult and was not removed by the Planna cloth towelett.

Applicant believes that a problem with prior cloth toweletts has been that the toweletts lack sufficient stiffness and thickness to be easily inserted into the printer or to adequately scrape off difficult contaminants from the printer. In particular, the toweletts are a single-ply cloth that quickly fold over when held upright on an edge. The toweletts have little stiffness, especially when compared to the paper card substrates that are as stiff as paper index cards. Accordingly, cloth toweletts have advantages over stiff paper cleaning cards, but the toweletts also suffer from disadvantages over paper cards. There has been a long-felt need for a printer cleaning card that combines the advantages of several different conventional cleaning cards and toweletts, is easy to use and does not interrupt the printing process solely for cleaning purposes.

The present invention solves many of the problems associated with prior printer cleaning cards and cleaning cloths. The present invention is a woven cleaning cloth formed from multiple layers of polypropylene, soaked in a terpene solvent. The layers of the polypropylene are bonded together by a sonic or thermal bonding process. The bonded, multilayer cleaning cloth has sufficient rigidity and stiffness so as to stand-on end to be easily inserted into the nip of a printer, and to scrap off contaminants from the printheads.

In addition, the bonding of the multiplies of the cleaning cloth is accomplished to impress a pattern, e.g., cross-hatching, zig-zag, tire-tread, or company logo, into the cloth. The pattern assists in providing stiffness to the cleaning cloth and in scraping contaminants from the printer. In addition, the pattern is helpful in bonding the layers of the cloth together, and in holding long fibers in the cloth. Moreover, the pattern may be eye-pleasing or provide promotional information, such as a patter in a company logo.

In addition, the cleaning cloth of the present invention is attached as a leader (or ender) to a roll of labels. As the roll of labels is inserted into the printer the cleaning cloth is pushed or pulled through the printer and across the printhead. Because the cleaning cloth is relatively stiff, the cloth can be used as a leader for a roll of labels being inserted into a printer. Because the cleaning card is attached to a roll of labels, the printer is cleaned when the a new printer roll is added to the printer (or when an old roll of label has completely passed through the printer if the cleaning cloth is at the end of the roll). The end or beginning of a roll of labels pass through a printer during the label roll changeover, which is a normal time during which the printer is offline. Having the cleaning cloth wipe over the printer at the roll changeover does not disrupt the printing operation, any more than that which inherently occurs by the roll changeover.

Moreover, the cleaning duties of the printer operator have been substantially reduced by the present invention. The operator need only remove the cleaning cloth from its sealed pouch and attach it to a roll, just before the roll is inserted in the printer. In addition, the end of a roll of labels is usually much easier to access to attach a cleaning cloth, than it is to access the internal components, i.e., printhead, of a printer to manually wipe with a cleaning cloth or card. The operator also need not separately schedule cleaning of the printer with cleaning card, as was done previously. The cleaning with the inventive cleaning cloth occurs when the label roll is changed. All the operator has to remember to do is attach the cleaning cloth to the label roll. Accordingly, the invention has fulfilled several of the long-felt needs for a printer cleaning card.

DESCRIPTION OF THE DRAWINGS

A preferred embodiment(s) of applicant's invention is described below with reference to the accompanying drawings having reference numerals corresponding to numeral used in the written description.

DESCRIPTION OF THE PREFERRED EMBODIMENT OF THE INVENTION

Figure 1:
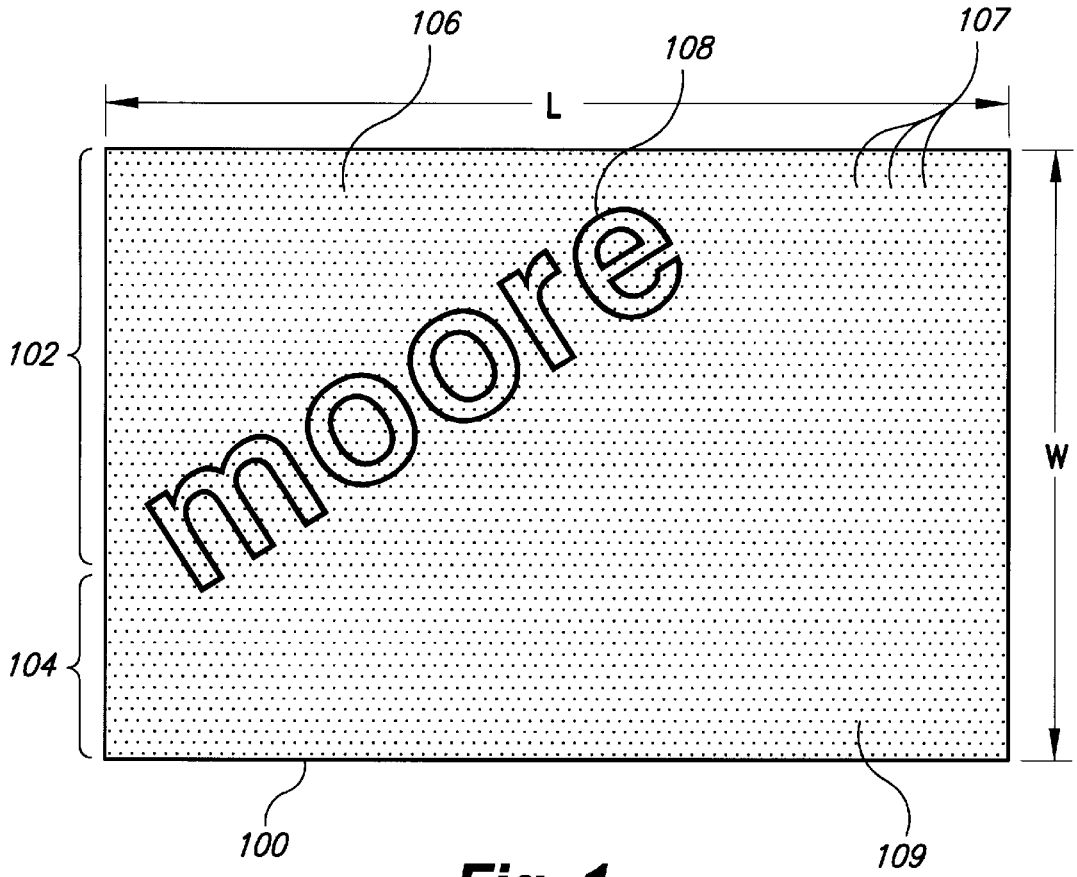
FIG. 1 is a plan view of a cleaning cloth embodying the present invention.

FIG. 1 shows a front view of an exemplary cloth printer cleaning card 100. The cleaning cloth is woven multi-ply material such as polypropylene. The cloth is relatively lint free to reduce the tendency of cloth fibers to become deposited on printers. The dimensions of the cloth cleaning card 100 are to be selected to suit the printer which the cloth is to clean. For example, the length (L) of a cloth may be 6 inches or whatever length is necessary to bridge all printheads in a printer. The width (W) of the cloth is also to be selected based upon the printer and application of the cloth. The width of the cloth should be sufficient to allow for a generous cleaning space 102 of the cloth, and may allow an area 104 for attachment to a leading or trailing edge of a roll of labels (see FIG. 3). An exemplary width of the cloth may be 4 inches.

The cleaning cloth 100 has an embossed pattern 106, such as a cross-hatch pattern as shown in FIG. 1. The pattern is formed when the multiple plies of the cloth are bonded together. Each point of bonding may form a pinch point 107 in the cloth where the plies are bonded together. The pattern provides a structural rigidity and stiffness to the cloth. In addition, the pattern provides a roughened surface texture to the cloth which facilitates the cleaning of the printer by the cloth. While a cross-hatch pattern 106 is shown in FIG. 1, other pattern shapes may be equally suitable for the cleaning cloth such as zig-zag patterns, nested circles and other geometric shapes, or more elaborate patterns, such as a visible company logo 108. If the company logo or other visually attractive pattern is used, the pattern has the additional benefit of providing promotional advertising to the company that is the source of the cleaning cloth. For example, an embossed "Moore" logo 108 may be pressed into the cloth to signify that the cleaning cloth originated from the Moore U.S.A. corporation.

The cloth is soaked with a terpene cleaning solvent 109. The solvent should be non-abrasive, and should be effective on adhesives and other contaminents commonly found in printers. Acceptable terpene solvents are discussed above in the background description. An acceptable terpene solvent may include limonene, which is an environmentally-safe solvent that has been found to remove waxes and adhesives from surfaces. Other acceptable components of a terpene solution may be other vegetable seed oils (esthers), myrcene, alphapinene, linaloo, 1-octanal and glycol ether DPM. The cloth 100 is soaked with a solvent until it is saturated, but is not dripping web with the solvent. The cloth should feel relatively dry after the solvent has been applied to the cloth. Because of its woven fabrics such as polypropylene, the cloth 100 is highly absorbent of the cleaning solvent. Moreover, the absorbency of the cloth is enhanced by using multiple-plies of the cloth. Because the cloth 100 is soaked with the cleaning solvent and because the cloth bears an embossed pattern providing a textured surface, the cloth is particularly effective at cleaning printers. In addition, both the front and back sides of the cleaning cloth are equally effective for cleaning surfaces in a printer.

Figure 2:
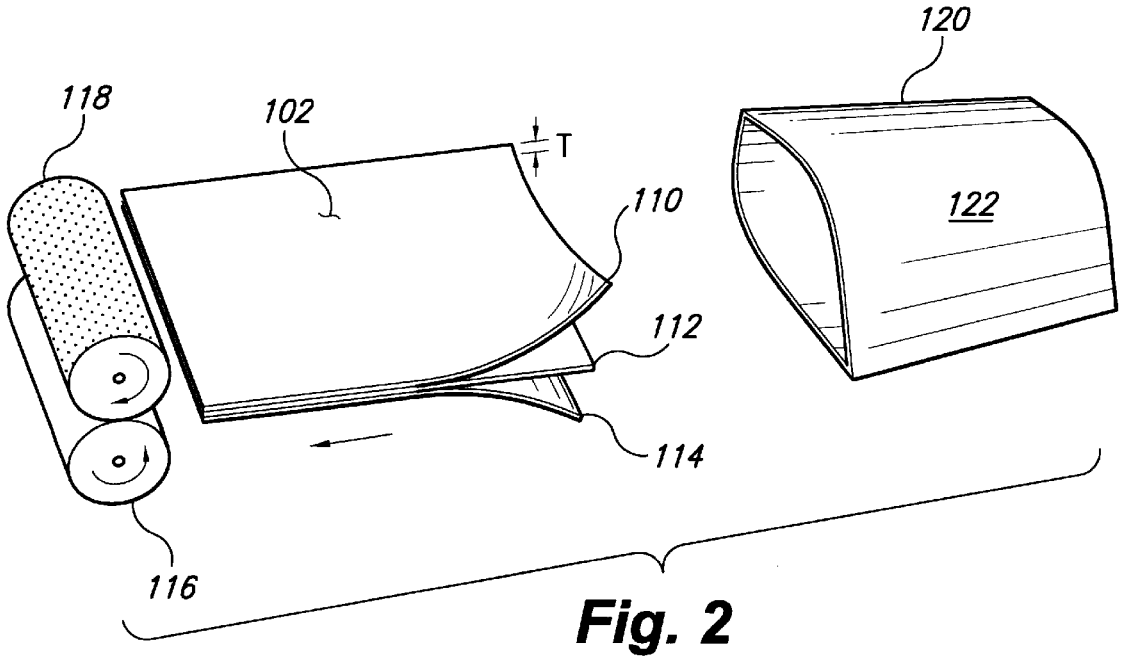
FIG. 2 is a perspective view of the cleaning cloth shown in FIG. 1, where the layers of the cloth have been partially peeled away to shown the structure of the cloth and showing envelope for cloth.

As shown in FIG. 2, the cleaning cloth 100 is formed of three plys 110, 112 and 114. Each ply may be a woven web of polypropylene, or other woven material that is relatively lint free. The web plys are arranged one on top of the other and bonded together through a sonic or thermal bonding process. For example, a pair of heated or sonic rollers 116 with a raised pattern 118 may bond the plies 110, 112, 114 of the cloth together. Both of the patterns 106, 108 may be embossed in the web cloth 100 during the bonding process. Because three plys are bonded together, the thickness (T) of the cloth web 100 is relatively great compared to traditional cleaning toweletts. The thickness is equal to or greater than the thickness of most paper substrate cleaning cards. For example, the thickness of an exemplary cloth 100 may be approximately ten-thousands of an inch thick.

Figure 3:
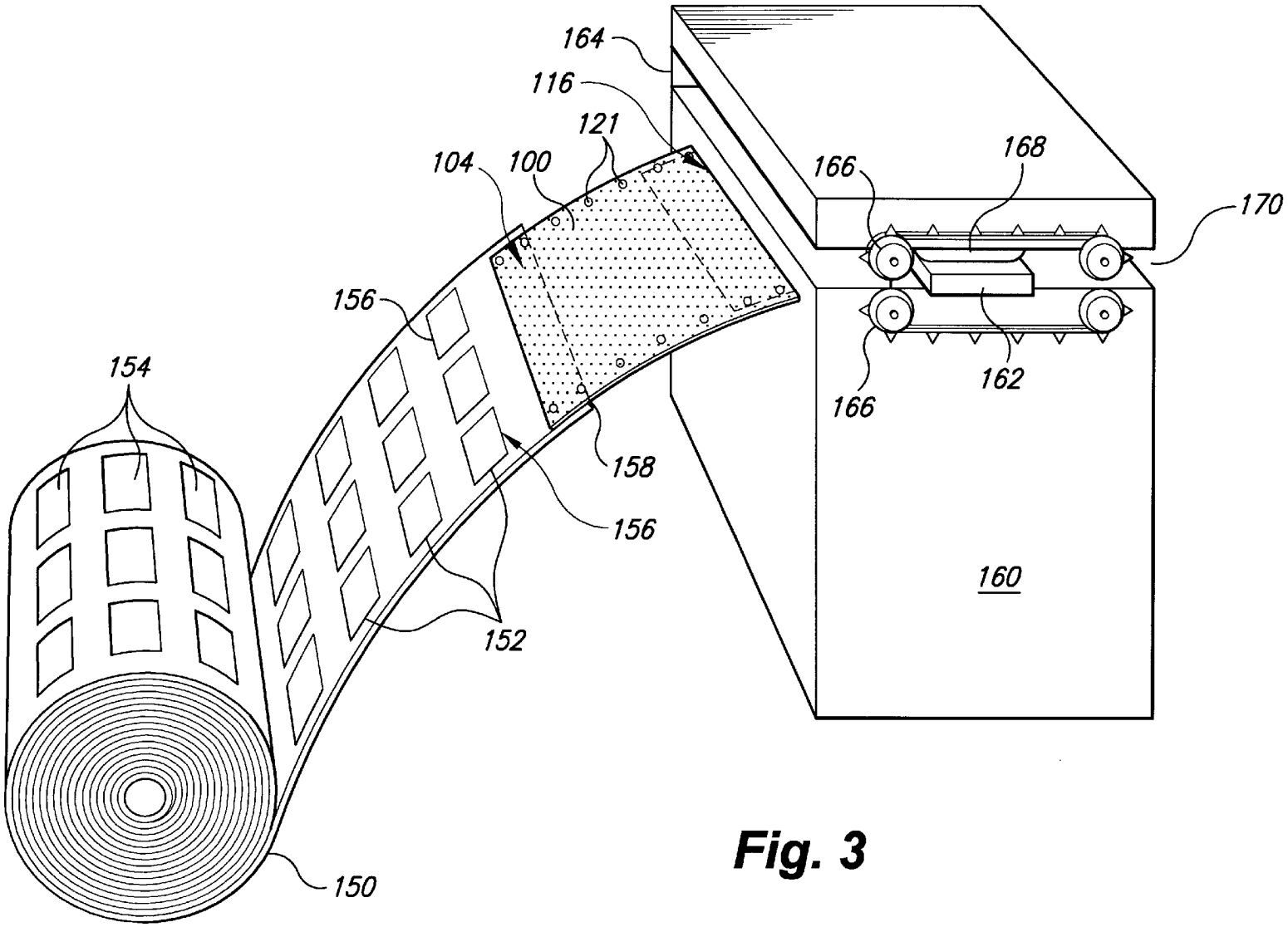
FIG. 3 is a diagram of the cleaning cloth of FIG. 1 attached to a roll of labels, that is being inserted into a printer.

The substantial thickness of the cleaning cloth is advantageous because it provides structural stiffness and rigidity to the cloth, and causes the cloth to fill most gaps in printers between the printer head 162 and printer platen 168 (FIG. 3). By filling the gap between a printer head and platen, the cloth provides a good wiping action against the printer head and platen as the cloth passes between the two. In addition, the thickness of the cloth is enhanced by the embossing of the pattern. As the pattern is embossed into the cloth and the plies are bonded together, the areas of the cloth not bonded together tend to balloon outwards to increase the thickness of the cloth.

The cleaning cloth 100 saturated with a cleaning solvent is sealed in an envelope 120 until use. The envelope 120 forms an exterior pouch to hold one or more of the solvent-soaked cloths 100 that prevents evaporation of the solvent from the cloth during storage. The envelope 120 may be formed of a web material 122 where the web is a four-layer construction of paper, low density polyethylene, foil and surlyn. This construction will ensure that the cleaning solvent is retained on the cloth 100 for a long shelf life while the cloth is stored in the envelope 120. The cloth is stored in a folded or unfolded arrangement within the envelope 120. The envelope edges are all sealed to prevent evaporation of the solvent on the cloth 100. When the cleaning cloth is to be used to clean a printer, the envelope 120 is opened and the cloth is removed.

FIG. 3 shows an example of a cleaning cloth 100 attached to a web roll 150 of labels 152. The labels may be multiple plies and/or have release liner backings 154. An adhesive coating 156 on the labels tends to adhere to the components of the printer 160 and mask the printhead 162. A roll of labels may be 500 feet or longer. By attaching a new cleaning cloth 100 to each roll 150 of labels, the printer is cleaned by the cloth 100 each time a new roll of labels is inserted into the printer 160.

The cleaning cloth 100 may be attached at its attachment area 104 using conventional means of attaching the cloth to a label roll. For example, the cloth may be stapled to the roll or an adhesive may be used to bond the cloth 100 to the leading edge 158 of the roll. The cleaning cloth is attached to the roll immediately after the cloth is removed from its sealed envelope 120 and immediately before the roll is to be inserted into the printer 160.

To insert the roll into the printer 160, the leading edge of the cleaning cloth 106 is inserted into the an inlet 164 of the printer. This inlet to the printer is used to feed the labels from the roll 150 through the printer during the printing process. The printer may include tractor feed 166 or other web advancement mechanism to move the web of labels through the printer 160. The cleaning cloth may have tractor feed holes 121 or other features to engage the tractor feed or other advancement mechanism so that the cloth 100 can be drawn into and through the printer 160.

As the cleaning cloth 100 moves through the printer, it moves between the printhead 162 and the platen 168, opposite to the printhead. As the cloth moves between the printhead and platen, the cloth cleans the face of the printhead. The solvent in the cloth softens any adhesive residue to facilitate the removal of the adhesive residue, paper dust, excess ink, toner particles and other contaminants that may have accumulated on the printhead. The cloth also cleans other components within the printer against which the textured surface of the cloth (formed by the pattern 106, 108) wipes as it moves through the printer. The cloth exits an output 170 of the printer. After the cloth exits the printer, it is removed from the label wall and the cloth is discarded.

The cleaning cloth 100 provides an easy-to-use, an expeditious device and method for rapidly cleaning high-speed printers 160 used for label printing. Because the cleaning cloth 100 is attached to a roll 150 of labels, the cleaning action performed by the cloth is accomplished at a time during printer operation in which the printer is normally off-line from printing. The cleaning by the cloth does not interrupt normal printing operation.

To improve the cleaning ability of the cloth, the multiple plies of the cloth, the thickness of the cloth, and the embossed pattern on the cloth all work together to improve the wiping action of the cloth within the printer. Moreover, the thickness of the cloth and its embossed pattern provide a stiffness to the cloth which make it easy to insert the cleaning cloth into the printer and allow the cleaning cloth to be a leader for the front edge 158 of a new roll of labels.

The present invention has been disclosed in what is considered to be its best mode. The invention is not limited to the best mode disclosed in this application. Rather, the invention encompasses the language and spirit of the attached claims.

What is claimed is:

1. A cleaning cloth assembly for a printer comprising:

a cleaning cloth having multiple plies of a woven web, wherein the multiple plies are superimposed over each other and bonded together;

a pattern embossed on the cleaning cloth which provides a surface roughness to facilitate a wiping action by the cloth;

a non-abrasive cleaning solvent absorbed within the woven plies, where the solvent is terpene based;

a removable envelope encasing the cleaning cloth; and an attachment area of the cleaning cloth to be attached to an edge of a roll of labels.

2. A cleaning cloth assembly as in claim 1 wherein the multiple plies are three plys.

3. A cleaning cloth assembly as in claim 1 wherein the plies are formed of polypropylene.

4. A cleaning cloth assembly as in claim 1 wherein the plies are sonically bonded and the pattern includes pinch points of bonding between the plies.

5. A cleaning cloth assembly as in claim 1 wherein thermal process is used to bond the plies and the pattern includes pinch points at which thermal bonding secures the plies together.

6. A cleaning cloth assembly as in claim 1 wherein the pattern includes a logo.

7. A cleaning cloth assembly as in claim 1 wherein the cleaning solvent is effective to soften adhesive residue on the printer.

8. A method for forming a printer cleaning cloth and cleaning a printer comprising the steps of:

a. embossing a multi-ply woven cleaning cloth with a pattern to impart a surface roughness to the cloth;

b. bonding plies of the cleaning cloth together;

c. applying a terpene-based cleaning solvent to the cleaning cloth;

d. after step c sealing the cleaning cloth in an envelope to minimize evaporation of the solvent from the sealing cloth;

e. removing the envelope from the cleaning cloth and attaching the cleaning cloth to a web of printable material;

f. inserting the web into a printer that prints onto the roll and moves the web through the printer, g. cleaning the printer as the cleaning cloth is drawn through the printer with the web.

9. A method as in claim 8 wherein the steps (a) and (b) are performed as a single step.

10. A method as in claim 8 wherein in step (a) the pattern includes a logo.

11. A method as in claim 8 wherein the web of printable material is paper.

12. A method as in claim 8 wherein in step (e) the web is a roll of labels.

13. A method as in claim 8 wherein in step 9*e*) the cleaning cloth is applied to a front edge of the web.

* * * * *